US007291014B2

(12) United States Patent
Chung et al.

(10) Patent No.: US 7,291,014 B2
(45) Date of Patent: Nov. 6, 2007

(54) WIRELESS DATA COMMUNICATION LINK EMBEDDED IN SIMULATED WEAPON SYSTEMS

(75) Inventors: Bobby Hsiang-Hua Chung, Atlanta, GA (US); Kelvin William Klusendorf, Sunnyvale, CA (US)

(73) Assignee: FATS, Inc., Suwanee, GA (US)

( * ) Notice: Subject to any disclaimer, the term of this patent is extended or adjusted under 35 U.S.C. 154(b) by 0 days.

(21) Appl. No.: 10/444,888

(22) Filed: May 23, 2003

(65) Prior Publication Data

US 2004/0121292 A1 Jun. 24, 2004

Related U.S. Application Data

(60) Provisional application No. 60/401,970, filed on Aug. 8, 2002.

(51) Int. Cl.
*F41G 3/26* (2006.01)

(52) U.S. Cl. ..... 434/11; 434/16; 434/19; 434/21; 434/22; 434/23

(58) Field of Classification Search ..... 434/11, 434/21, 22, 23, 27
See application file for complete search history.

(56) References Cited

U.S. PATENT DOCUMENTS 4,352,665 A 10/1982 Kimble et al.
4,553,943 A 11/1985 Ahola
4,640,514 A 2/1987 Myllyla
4,823,401 A 4/1989 Gammarino et al.
5,427,380 A 6/1995 Hazard et al.
5,569,085 A * 10/1996 Igarashi et al. ..... 463/49
5,613,442 A 3/1997 Ahola
5,660,549 A 8/1997 Witt, III
5,742,251 A 4/1998 Gerber
5,788,500 A 8/1998 Gerber
5,816,817 A 10/1998 Tsang et al.
5,823,779 A 10/1998 Muehle et al.
5,842,300 A * 12/1998 Cheshelski et al. ..... 42/116
5,864,481 A * 1/1999 Gross et al. ..... 700/90
5,892,221 A 4/1999 Lev (Continued)

FOREIGN PATENT DOCUMENTS

FR 79 00277 8/1979

OTHER PUBLICATIONS

Whatis.com—dictionary definitions "radio frequency", Jul. 31, 2001, p. 1-3.*
Whatis.com—dictionary definitions "frequency-hopping spread spectrum", Feb. 23, 2001, p. 1-3.*
Budek, Bluetooth Application Note #5; Martan Inc., Revised Oct. 14, 2002.

(Continued)

*Primary Examiner*—Robert E. Pezzuto
*Assistant Examiner*—Cameron Saadat
(74) *Attorney, Agent, or Firm*—Smith Gambrell & Russell LLP

(57) ABSTRACT

A weapon simulator assembly having a wireless module provided in a simulated weapon to maximize the freedom of movement for the user and to provide complete diagnostics from electronic sensors for users of the firearms training simulator. The wireless module is embedded in the simulated weapon used in the simulator assembly and connected to various sensors to obtain operational information. The wireless data communication link is a wireless module using a frequency hopping spread spectrum technology such that the wireless module can fit in a small firearm simulator, such as a handgun or chemical spray simulator.

23 Claims, 6 Drawing Sheets

U.S. PATENT DOCUMENTS

| | | | | |
|---|---|---|---|---|
| 5,966,226 | A | 10/1999 | Gerber | |
| 6,254,394 | B1 * | 7/2001 | Draper et al. | 434/11 |
| 6,283,756 | B1 | 9/2001 | Danckwerth et al. | |
| 6,433,685 | B1 | 8/2002 | Struble et al. | |
| 6,448,906 | B1 | 9/2002 | Nachtsheim et al. | |
| 6,449,892 | B1 * | 9/2002 | Jenkins | 42/1.01 |
| 6,646,643 | B2 | 11/2003 | Templeman | |
| 6,782,245 | B1 | 8/2004 | Lazzarotto | |
| 2001/0029011 | A1 | 10/2001 | Dagani | |
| 2002/0010021 | A1 * | 1/2002 | McCauley | 463/37 |
| 2002/0067350 | A1 | 6/2002 | Ben Ayed | |

OTHER PUBLICATIONS

Budek, Bluetooth Application Note #1; Martan Inc., Revised Sep. 26, 2002.

Wireless; Searchnetworking.com Definitions, www.searchnetworking.com, printed no later than May 23, 2003.

Intel Personal Wireless Module and Intel Personal Wireless Software Keep You Connected Without Wires; printed no later than May 23, 2003.

Broersma, Can Cypress Bite Into Bluetooth Market?; www.news.com, printed no later than May 23, 2003.

* cited by examiner

WIRELESS DATA COMMUNICATION LINK EMBEDDED IN SIMULATED WEAPON SYSTEMS

CROSS REFERENCE TO RELATED APPLICATIONS

The present application claims benefit of Provisional Patent Application No. 60/401,970, filed on Aug. 8, 2002.

BACKGROUND OF THE INVENTION

1. Field of the Invention

The present invention relates to simulated weapons and, more particularly, to untethered simulated weapons having a wireless connection with a central simulation computer.

2. Description of the Prior Art

A firearms training simulator is a device used to train police and military personnel in the proper use and handling of weapons without having to use actual firearms and ammunition. The firearms simulator is designed for indoor training in a safe environment. An effective firearms simulator duplicates the actual environment as much as possible by using weapons that "look and feel" like the real weapon. The primary objective is to immerse the trainee in a situation so that his responses will be the same as in real life. If this is achieved, the instructor can effectively educate the trainee on the correct responses, actions, and behaviors in extraordinary situations. To facilitate this, the instructor will need as much feedback as possible from sensors or other electronic devices to know the exact state of the trainee's devices, such as feedback from position sensors, trigger sensors, and other similar sensored devices. Currently, this feedback is most commonly accomplished via a wired communication link that limits the full mobility of the trainee. Moreover, many simulators today have multiple devices operating at the same time similar to a network of devices.

Weapons training courses provide environments in which users can be trained in the use of weapons or can refine weapons use skills. At such weapons training courses, users may train with conventional firearms, such as pistols and rifles, or other weapons, such as a chemical spray. Regardless of the type of weapon used, training typically includes a zone in which the participant is positioned. The participant then projects some form of projectile from the zone toward a target. One of the most common examples of such a system has a participant firing a pistol from a shooting location toward a bull's-eye paper target. To improve the realism of the weapons familiarization process and to also provide a more "lifelike" experience, a variety of approaches have been suggested to make the weapons range more realistic. For example, some weapons ranges provide paper targets with threatening images rather than the single bull's-eye target.

In various attempts to present a more realistic scenario to the participant and to provide an interactive and immersive experience, some training simulators have replaced such fixed targets with animated video images. Typically these images are projected onto a display screen, such that the animated images present moving targets and/or simulated return threats toward which the participant fires.

In one such environment, described in U.S. Pat. No. 3,849,910, a participant fires at a display screen upon which an image is projected. A position detector then identifies the "hit" location of bullets and compares the hit location to a target area to evaluate the response of the participant.

In an attempt to provide an even more realistic simulation to the participant, U.S. Pat. No. 4,695,256 incorporates a calculated projectile flight time, target distance, and target velocity to determine the hit position. Similarly, United Kingdom Patent No, 1,246,271 teaches freezing a projected image at an anticipated hit time to provide a visual representation of the hit.

Rather than limiting themselves to such unrealistic experiences, some participants engage in simulated combat or similar experiences, through combat games such as laser tag or paint ball. In such games, each participant is armed with a simulated fire-producing weapon in a variety of scenarios. Such combat games have limited effectiveness in training and evaluation, because the scenarios experienced by the participants cannot be tightly controlled. Moreover, combat games typically require multiple participants and a relatively large area for participation.

All prior art attempts to simulate weapons fire have disadvantages and drawbacks. Many of the drawbacks are associated with the necessity for the simulated weapon to be tethered by a control cable to a console in order to transmit signals to determine hits and other related information. Meanwhile, other simulators do not provide an efficient means for monitoring the accuracy of shots fired.

What is desired, then, and not found in the prior art, is a weapons simulator assembly that provides the use of an untethered simulated weapon that provides operational feedback for the user.

SUMMARY OF THE INVENTION

The present invention provides a weapon simulator having a wireless module or data communication link embedded in the weapon simulator to transmit operational information of the weapon simulator to a central processing unit that also contains a wireless transceiver. The wireless module includes a wireless transceiver that provides a signal using frequency hopping spread spectrum technology. One or more sensors may also be attached or embedded within the weapon simulator, with the sensors being connected to the wireless module. Additionally, the weapon may include a laser module attached to the wireless module.

DESCRIPTION OF THE PREFERRED EMBODIMENT

Figure 1:
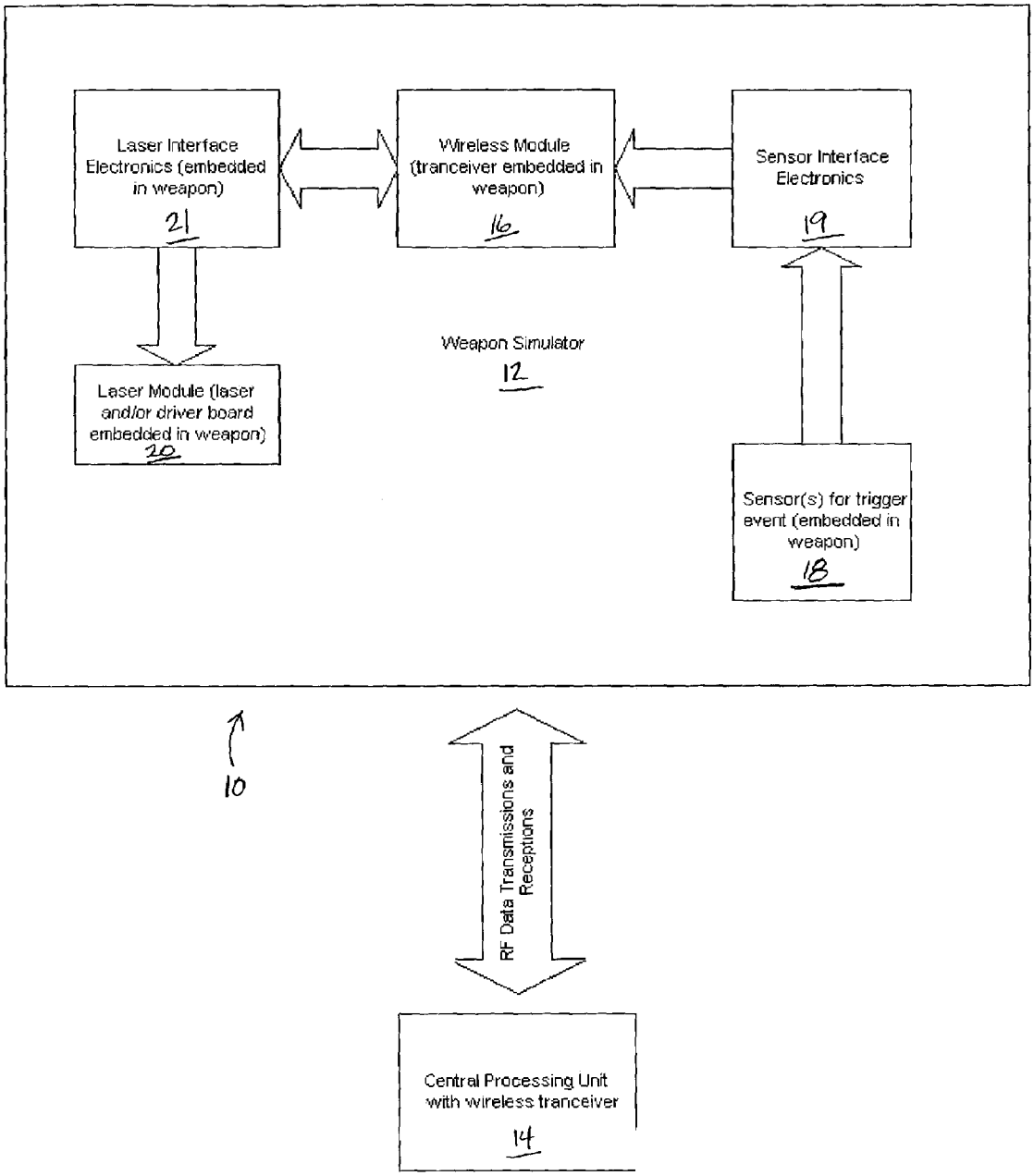
FIG. 1 is a block diagram of a first embodiment of the weapon simulator of the present invention.

Looking to FIGS. 1 through 5, block diagrams of the various embodiments of the present invention of a weapon training simulator assembly 10 are illustrated. The preferred embodiment of the weapon training simulator assembly 10 includes a weapon simulator 12 that has a wireless connection with central processing unit 14, with the central processing unit 14 acting as the central simulation computer. The weapon simulator 12 transmits information concerning operation of the weapon simulator 12 to the central processing unit 14. More specifically, a wireless module 16 is either embedded within or attached to the weapon simulator 12 to transmit the information to the wireless transceiver of the central processing unit 14. The wireless module 16 may be connected to multiple other devices, such as monitoring sensors 18 or a laser module 20, for monitored operation of the weapon simulator 12. The wireless module 16 includes the electronic equipment necessary to provide radio frequency ("RF") transmission, not including an antenna. In particular, the wireless module 16 includes an embedded microcontroller for controlling RF transmission and can be used for weapon control such as a weapon jam and monitoring.

With respect to the wireless module 16, it should be noted that wireless technology has been around for many years, and there have historically been two means of transmitting data without a wired connection to a receiver: (1) RF transmissions; and (2) "line of sight" transmissions, such as using light or sound transmissions The advantage of using RF transmissions is mainly the fact that the receiver does not have to be in the "line of sight" of the transmitter for a transmission to take place. This gives the user the convenience of having a truly wireless system with maximum mobility. Historically, however, equipment for providing RF transmissions has been sizeable, and not capable of fitting into a small space such as a firearm simulator.

In order for a wireless RF communication to be effectively used in weapons training, the wireless device has to be low power, low cost, and small enough to fit into the smallest device used in a weapons training simulator assembly 10. Such a wireless device was not possible until prior to a new standard of wireless transceivers that became available to the personal computer ("PC") and consumer markets. However, the design of such wireless devices began when the Federal Communications Commission allowed the 900 MHz frequency and the 2.4 GHz frequency to be license-free to users. However, even with the new equipment, the available wireless transceivers were still not small enough for use in weapons training devices such as handguns. As the digital wireless phones and other wireless devices gained popularity, the need for a standard began to emerge because manufacturers wanted to concentrate on making the transceivers smaller, low power, and cheaper in price.

As a result of this demand, two digital wireless standards have taken precedence: IEEE 802.11b for wireless networks and a more generic wireless standard called Bluetooth that was introduced in 1999. More specifically, Bluetooth is a computing and telecommunications industry specification that describes how mobile phones, computers, and personal digital assistants ("PDAs") can easily interconnect for a seamless transfer of information among users using home and business phones and computers using a short-range wireless connection.

It should further be noted that Bluetooth may be incorporated into the present invention because it employs frequency-hopping spread spectrum ("FHSS") in signal transmission. FHSS is a modulation technique that repeatedly changes the frequency of a transmission to prevent unauthorized interception of the transmission. The data signal is modulated with a narrowband carrier signal that "hops" in a random but predictable sequence from frequency to frequency as a function of time over a wide band of frequencies. This technique reduces interference because a signal from a narrowband system will only affect the spread spectrum signal if both are transmitting at the same frequency at the same time. FHSS consumes less power and has increased reliability than other transmission techniques.

With the new digital wireless standards, manufacturers for the digital transceivers began making these transceivers smaller. In particular, devices that followed the Bluetooth standard had the most promise in being the smallest and least cost since Bluetooth has potentially more widespread use. The smallest version to date is a fully contained Bluetooth module that is about 0.50 inches by 0.75 inches. Moreover, a Bluetooth device provides a less powerful signal in operation than the IEEE 802.11b, and therefore requires less battery power for desired operation.

In view of the small size of the wireless module 16, the present invention is able to include a wireless module 16 to solve the problems identified above. In particular, the wireless module 16 is installed with the weapon simulator 12 so that information may easily be transmitted to the central processing unit 14 as needed. This wireless module 16 is ideal for mounting in any device used in a weapons training simulator assembly 10. In addition, the embedded microcontroller of this wireless module 16 can also be used to interact with the various sensors 18 of the firearms simulator device 12 as described herein, as well as the central simulation computer 14, which further reduces the electronics required.

A low-cost transceiver chip is included in each wireless module 16 that is used to transmit or receive information. In the present case, the transceiver is in both the central processing unit 14 and the wireless module 16. The transceiver transmits and receives in a previously unused and unregulated frequency band of 2.4 GHz that is available globally (with some variation of bandwidth in different countries). In addition to data, up to three voice channels are available. Each device has a unique 48-bit address from the IEEE 802 standard. Connections can be point-to-point or multipoint, although the maximum range is approximately ten meters. Furthermore, data can be exchanged at a rate of approximately 723 kilobits per second. A frequency hop scheme allows devices to communicate even in areas with a great deal of other radio frequency or electromagnetic interference. Moreover, the wireless module 16 provides for built-in encryption and verification of transmitted and received information.

Figure 2:
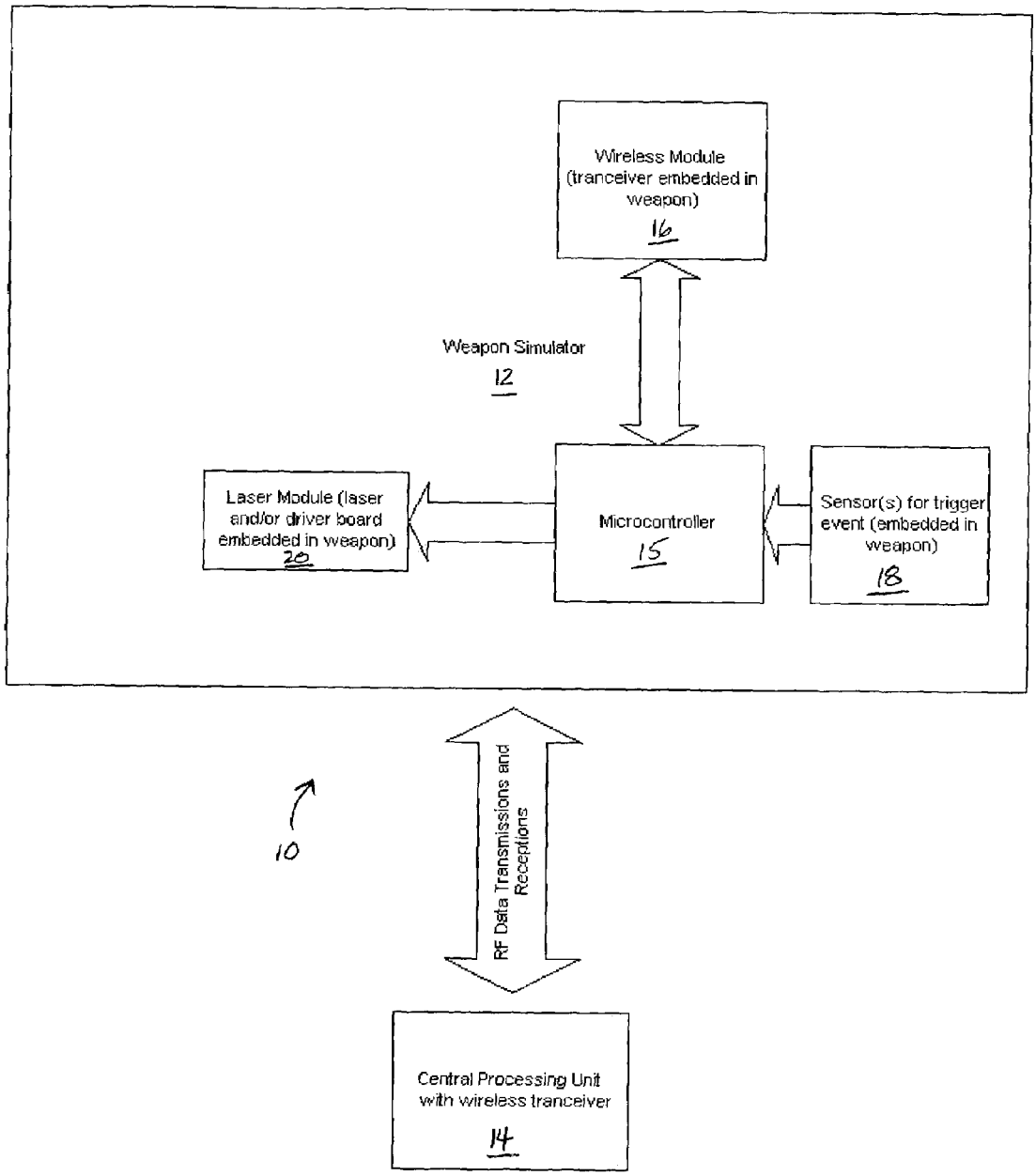
FIG. 2 is a block diagram of a second embodiment of the weapon simulator of the present invention.
Figure 3:
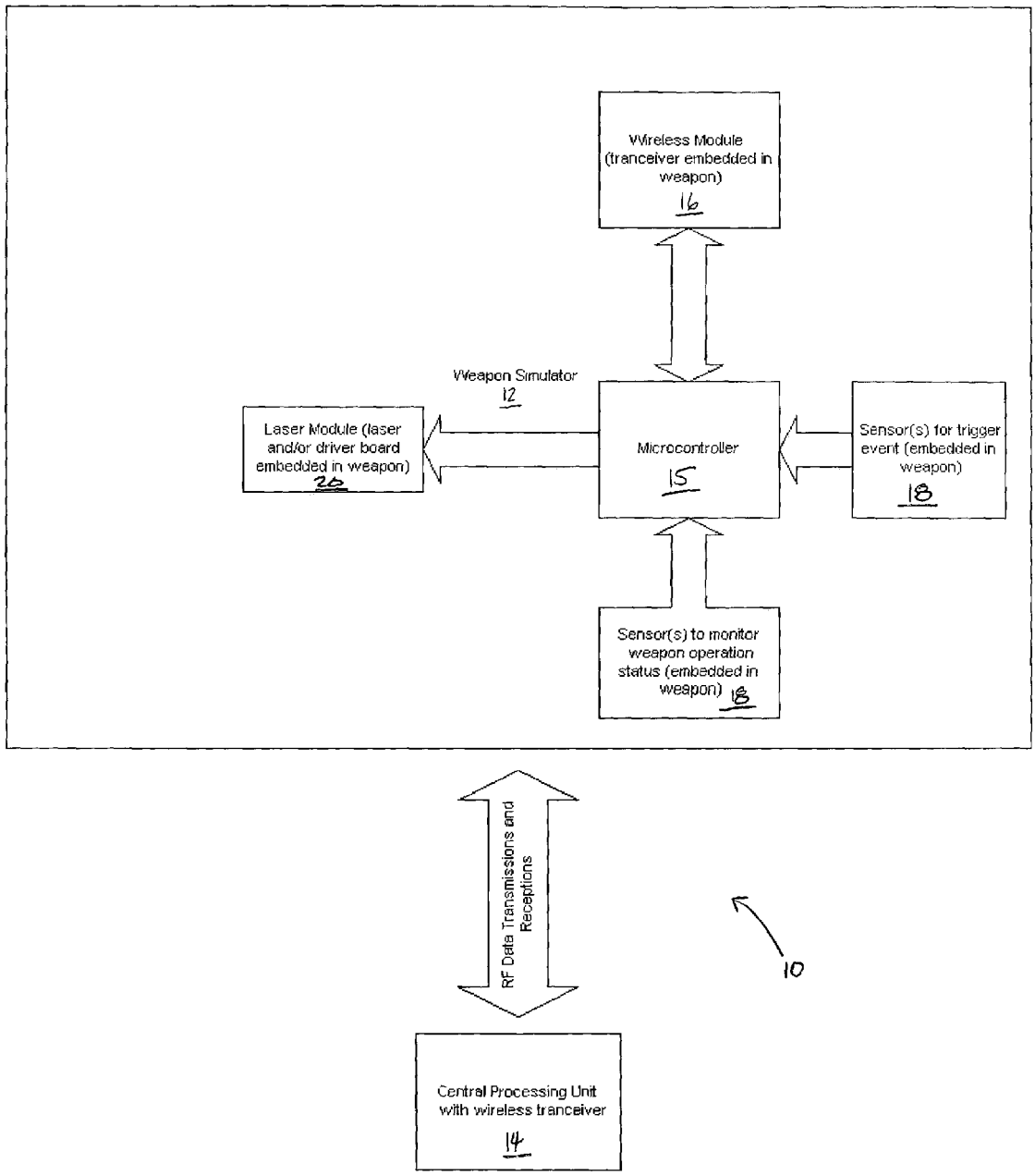
FIG. 3 is a block diagram of a third embodiment of the weapon simulator of the present invention.
Figure 4:
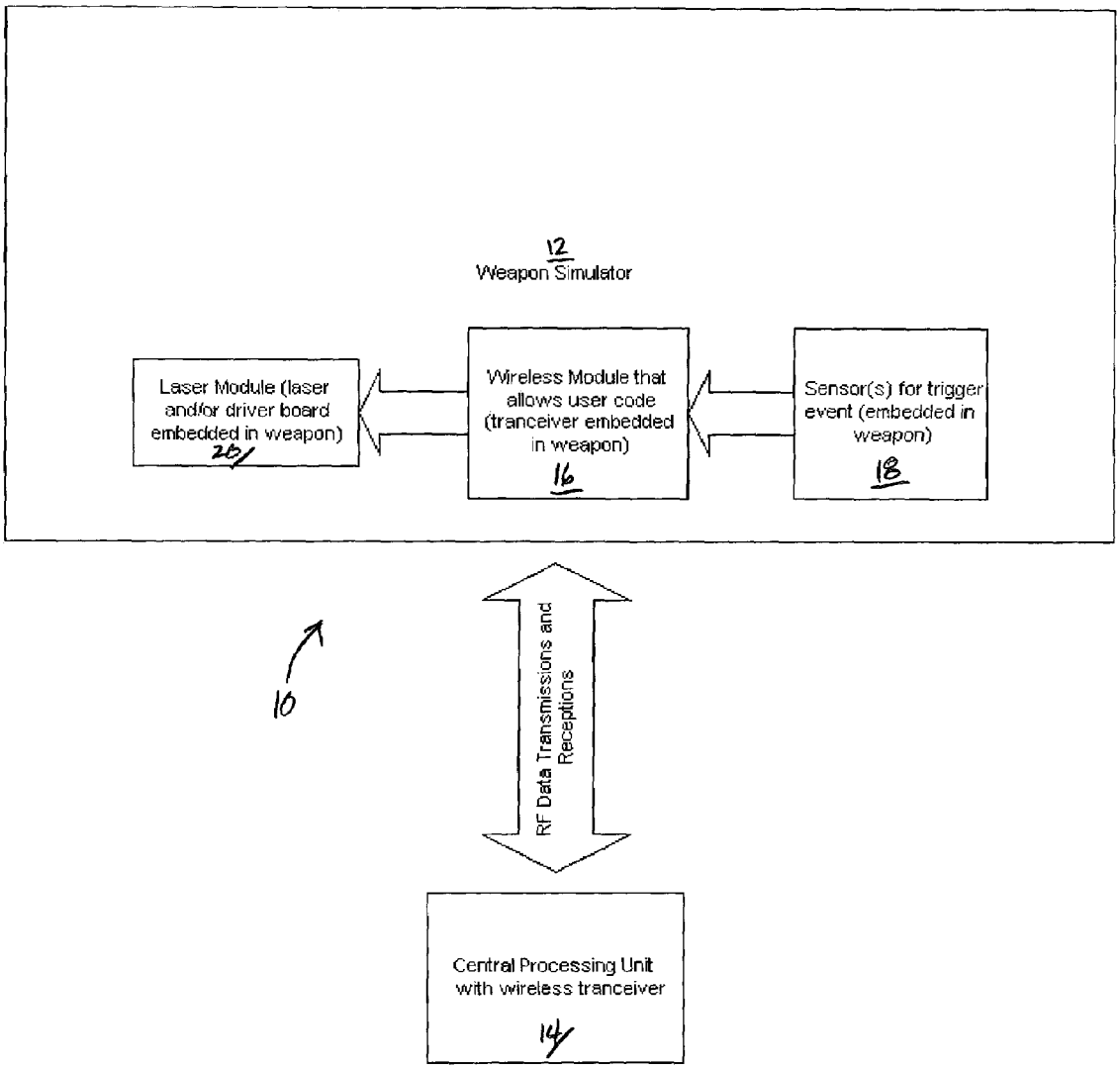
FIG. 4 is a block diagram of a fourth embodiment of the weapon simulator of the present invention.
Figure 5:
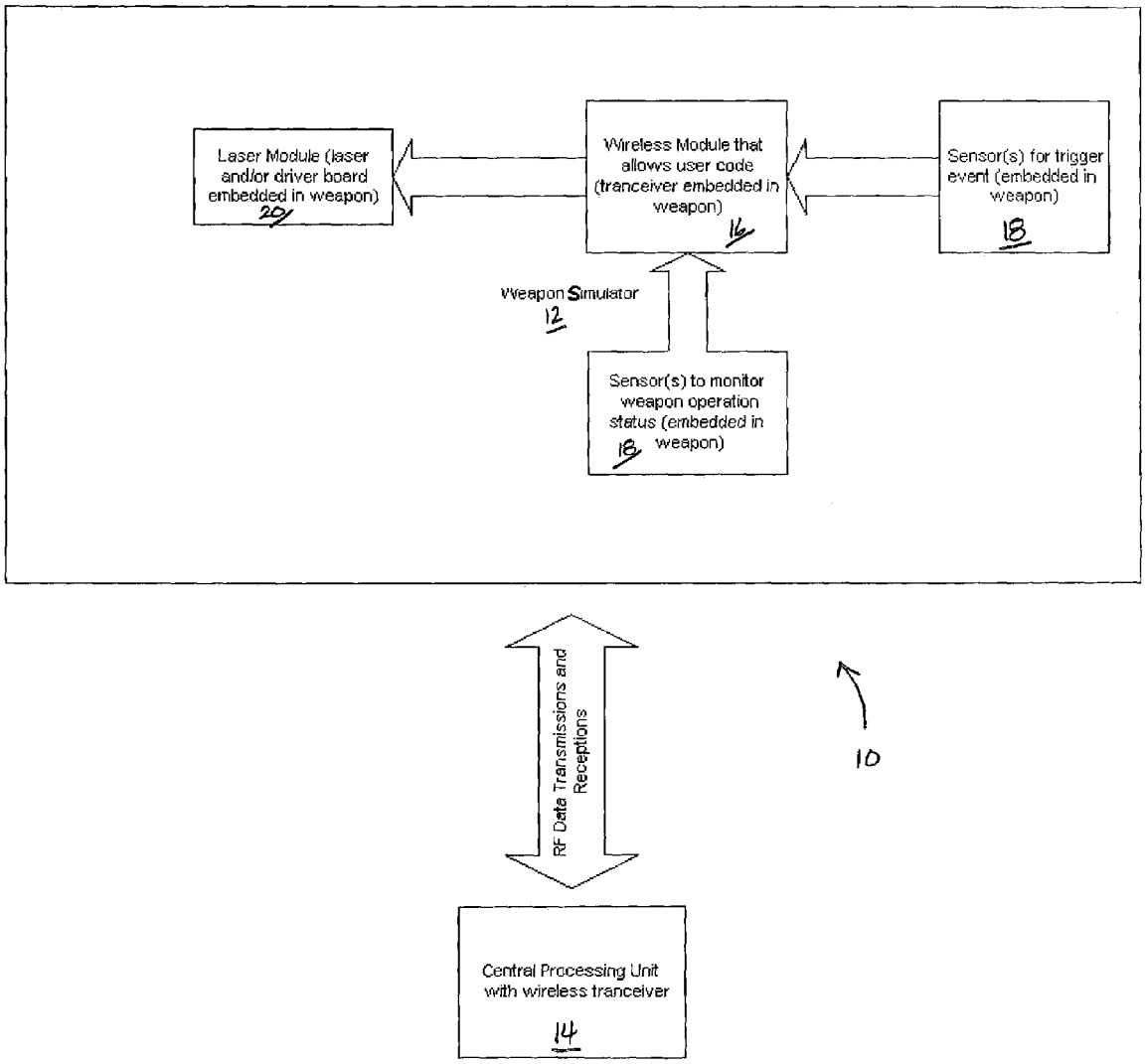
FIG. 5 is a block diagram of a fifth embodiment of the weapon simulator of the present invention.

As discussed above, one or more sensors 18 will be attached to the weapon simulator 12. For example, a pistol-shaped weapon simulator 12 may include a magazine sensor, hammer sensor, bolt sensor, safety sensor, or a trigger sensor. Such sensors 18 can take the form of an electrical switch or a mechanical switch, among other embodiments. Each of these sensors 18 will be linked to a detection unit, which may take the form of interface electronics 19 monitoring the state of each sensor 18 (as shown in FIG. 1), a microcontroller 15 connected to each sensor 18 (as shown in FIGS. 2 and 3), or an embedded controller in the wireless module 16 connected to each sensor 18 (as shown in FIGS. 4 and 5). The specific operational information provided by each sensor 16 will therefore either be transmitted to the wireless module 16 by the detection unit (i.e., the interface electronics 19, the microcontroller 15, or the embedded controller). Once received by the wireless module 16, the signal may easily be transmitted to the central processing unit 14.

In one embodiment of the invention, the laser module 20 and associated laser interface electronics 21 are included to determine the position of the simulator 12 at the time of firing of the simulator 12. However, it should be noted that other sensors might be used in place of the laser module 20, such as a gyroscope, that determines the position of the firearm simulator 16.

Figure 6:
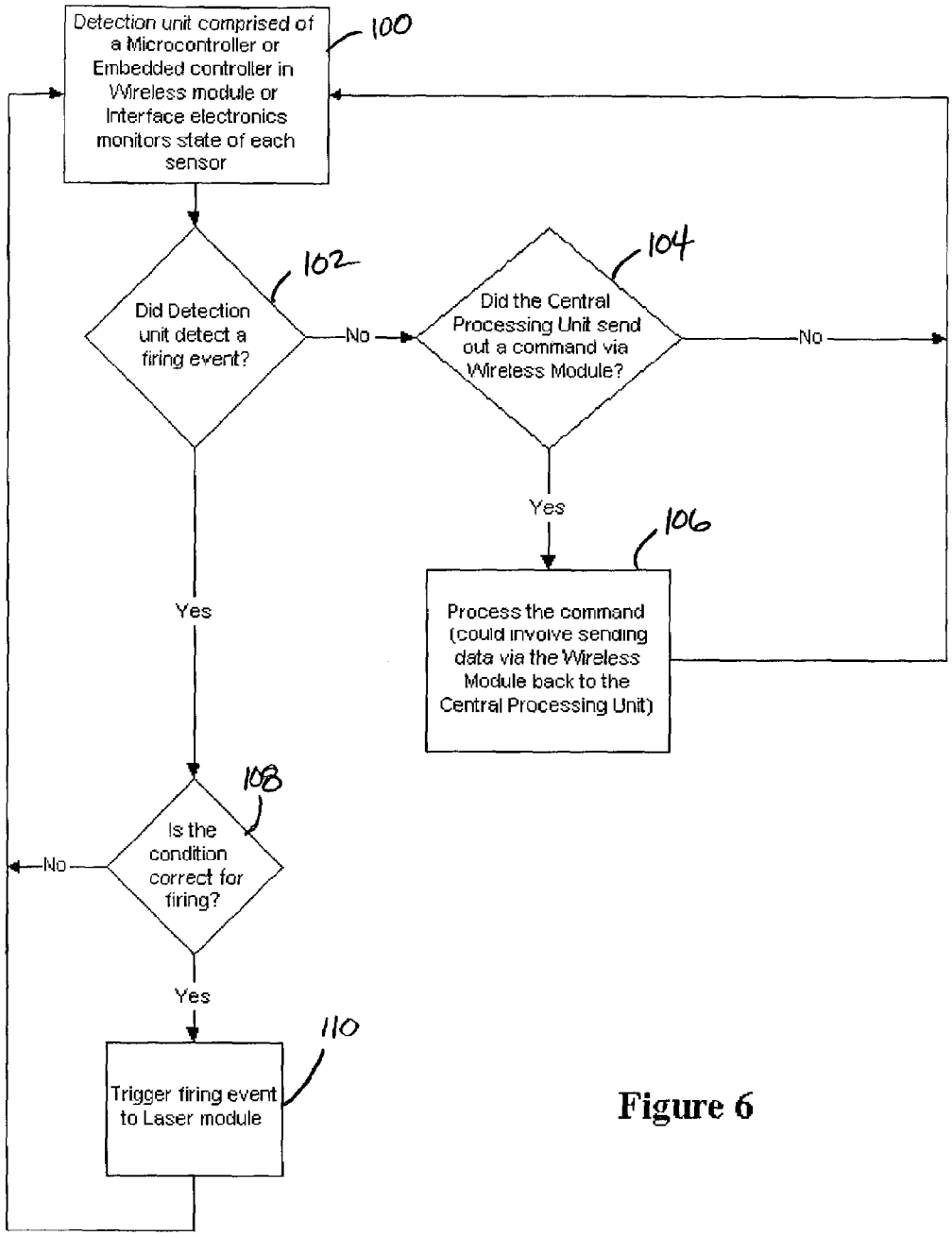
FIG. 6 is a flow chart illustrating operation of the weapon simulator of the present invention.

The method for monitoring the status of the simulated weapon 12 is illustrated in FIG. 6. The method of use begins with the operation of a detection unit. As stated above, the detection unit can take the form of the interface electronics 19 monitoring the state of each sensor 18 (as shown in FIG. 1), the microcontroller 15 connected to each sensor 18 (as shown in FIGS. 2 and 3), or the embedded controller in the wireless module 16 connected to each sensor 18 (as shown in FIGS. 4 and 5). In any of these embodiments, the detection unit initially monitors the state of each sensor 18, as illustrated as step 100. At step 102, the detection unit determines whether there was a firing event from a trigger sensor 18. If there was no firing event at step 102, then the central processing unit 14 must determine if a command was sent to the wireless module 16 as shown in step 104. If a command was sent, then the command is processed as shown in step 106, and the detection unit once again monitors each sensor as in step 100. If no command was sent, then the detection unit simply begins once again to monitor the state of each sensor 18 as provided in step 100.

Referring back to step 102, if a firing event did take place, then the detection unit verifies that the condition is suitable to the firing event in step 108. In determining whether the simulated weapon 16 is suitable for the firing event, a number of sensors 18 may be used to determine the status of the simulated weapon 16. For example, a sensor 18 may determine if a bullet or cartridge is properly loaded into the simulated weapon 16, or whether the bolt of the simulated weapon 16 is in the proper position. If the simulated weapon 16 is suitable for firing, the laser module 20 is activated and a laser discharged according to step 110. Otherwise, the detection unit weapon returns to step 100, and continues to monitor each sensor 18.

It should be noted that various devices are used in a weapons training simulator assembly 10, such as firearms simulators, motion tracking devices, or other similar devices, to enhance training of a student. Such devices are typically connected by a serial or parallel data wired connection, and these devices can be many for each student. Eventually, as the number of devices increase, the mobility of the student can be significantly restricted. This in turn will make the simulator less ideal since real life situations cannot be achieved.

Examples of various weapon simulators 12 that benefit from the incorporation of a wireless module 16 include the following:

1) A weapon simulator 12 such as a handgun with various diagnostic sensors can be completely free of external wires for data communications and control using a wireless link such as a wireless module 16. This wireless weapon simulator 12 can give the user maximum freedom of movement and will give the same "look and feel" as the real weapon while providing the instructor with the exact state of the weapon.

2) A crowd control device simulator such as a stun gun or chemical spray can be completely free of external wires for data communications and control using the wireless module 16 as a wireless link. This allows for maximum freedom of movement while providing important training requirements such as ineffective stun gun or an emptied chemical spray.

3) Peripheral device simulators such as binoculars and laser range finders carried by military personnel can be completely free of external wires for data communications and control using a wireless link such as a Bluetooth device. This will allow for both maximum freedom of movement and the most realistic training.

4) A position tracking device such as a gyro/accelerometer combination can be completely wireless using a wireless link to allow a student to have maximum freedom of movement and minimum intrusion of the tracking device.

5) Various sensors worn by the student, such as a holster sensor determining the presence of the firearm, various room sensors that can detect a person's presence, or hit sensor can be completely wireless using a wireless link to minimize on entanglement and maximize the freedom of movement.

6) A keypad used by the trainee to navigate through the courses offered at his/her own pace could be wireless using a wireless link to minimize entanglement and maximize the freedom of movement.

One of the main purposes for a serial or parallel data connection is to allow complete control of the device to the central simulation computer 16. The device can send measured data for the student's diagnostics and it can be commanded to perform tasks to provide complete interactivity.

In one example of the use of the present invention, a wireless module 16 is operated as a serial cable replacement. In particular, by connecting the transmit data ("TXD") and receive data ("RXD") pins of the Universal Asynchronous Receiver/Transmitter ("UART") of the wireless module 16 with the respective TXD and RXD pins of the weapon's microcontroller 15, with Clear-to-Send ("CTS") and Request-to-Send ("RTS") connected, a 3.3 VDC supply, and 2.4 GHz, 50 Ohm antenna, a simple serial cable replacement is made. Flashing the correct firmware to activate the serial connection with the correct baud rate must be done to the wireless module 16 prior to assembly. Both the weapon's microcontroller board and the wireless module 16 can be mounted inside a simulator device with a small antenna and battery.

In another example of the use of the present invention, a wireless module 16 operates as the wireless communication link and a microcontroller 15 for the weapon simulator 12 (see FIGS. 2 and 3). The Wireless module 16 has eight GPIO's (general purpose input/outputs) that can be sensor inputs and laser driver outputs to a laser module 22. Any simulator device that needs at most eight GPIO's can use this method. A typical pistol simulator will include a magazine sensor, hammer sensor, bolt sensor, safety sensor and trigger sensor, as well as a laser driver output. The output of the various sensors will be connected to one of the eight GPIO's and the laser driver circuit will be connected to another GPIO. A 3.3 VDC supply and antenna will be added to complete the circuit. A connector to the TXD, RXD, CTS, and RTS lines can be added to allow flashing to the microprocessor. The entire package will be the wireless module 16 with a connector, laser driver circuit, small antenna, and a battery mounted inside the handgrip of a handgun of the weapon simulator 12.

For experimentation purposes, two evaluation units of the present invention were tested, and latency was measured to be within acceptable limits of the weapons training simulator assembly 10. The serial interface was enabled on the evaluation units which allowed us to test the cable replacement concept. A simulated or replicated weapon was connected to the evaluation unit and linked wirelessly to the weapon simulator 12. All features of the weapon simulator 12 were tested and passed, including sensor diagnostics and commands. As a result, a fully functional chemical spray prototype was developed and operated with the wireless module and the weapon controller card. Also, there was a successful effort in porting over the weapon controller card communication firmware into the wireless module.

Thus, although there have been described particular embodiments of the present invention of a new and useful WIRELESS DATA COMMUNICATION LINK EMBEDDED IN SIMULATED WEAPON SYSTEMS, it is not intended that such references be construed as limitations upon the scope of this invention except as set forth in the following claims.

The invention claimed is:

1. A weapon simulator assembly having a wireless connection to a central processing unit providing free motion for a user of said weapon simulator assembly, the central processing unit having a first wireless transceiver, said weapon simulator assembly comprising:

an untethered simulated small arms weapon having a frame;

a trigger sensor mounted within said simulated small arms weapon to generate a corresponding trigger sensor signal;

a magazine sensor mounted within said simulated small arms weapon to generate a magazine sensor signal corresponding to the connection of a magazine with said frame of said simulated small arms weapon; and a wireless module mounted within said simulated small arms weapon in continuous electrical communication with said trigger sensor and said magazine sensor to receive said trigger sensor signal and said magazine sensor signal, said wireless module having a second wireless module transceiver; and wherein said second wireless transceiver of said wireless module transmits said trigger sensor signal and said magazine sensor signal to the first wireless transceiver using a radio frequency based transmission.

2. The weapon simulator assembly as described in claim 1 wherein said second wireless transceiver receives commands from said first wireless transceiver.

3. The weapon simulator assembly as described in claim 1 wherein said second wireless transceiver is a frequency hopping spread spectrum transceiver.

4. The weapon simulator assembly as described in claim 1 further comprising sensor interface electronics, said sensor interface electronics connecting said trigger sensor and said magazine sensor with said wireless module within said simulated small arms weapon.

5. The weapon simulator assembly as described in claim 1 wherein the radio frequency of data transmitted from said wireless transceivers is substantially within the 2.4 GHz band.

6. The weapon simulator assembly as described in claim 1 further comprising aiming means for determining the position of said simulated small arms weapon.

7. The weapon simulator assembly as described in claim 6 wherein said aiming means comprises a laser module connected to said simulated small arms weapon.

8. The weapon simulator assembly as described in claim 7 further comprising laser interface electronics, said laser interface electronics connecting said wireless module with said laser module.

9. The weapons simulator assembly as described in claim 1 further comprising a microcontroller connected to said simulated small arms weapon.

10. The weapon simulator assembly as described in claim 9 further comprising a power supply connected to said microcontroller.

11. The weapon simulator assembly as described in claim 1 further comprising an antenna within said simulated small arms weapon connected to said wireless module.

12. The weapon simulator assembly as described in claim 1 wherein said trigger sensor comprises a mechanical switch.

13. The weapon simulator assembly as described in claim 1 wherein said simulated small arms comprises a crew-served weapon housing.

14. The weapon simulator assembly as described in claim 1 wherein said simulated small arms weapon comprises a firearm housing.

15. A wireless weapon simulating system comprising:

a central simulation computer;

a man-portable weapon simulator having a frame and a magazine connected to said frame;

a trigger sensor connected to said frame for monitoring the operation of said man-portable weapon simulator, wherein said trigger sensor generates a trigger sensor signal;

a magazine sensor connected to said frame for monitoring the connection of a operation of said man-portable weapon simulator, wherein said trigger sensor generates a trigger sensor signal; and a wireless module having a transceiver, said wireless module mounted to said frame within said man-portable weapon simulator, said wireless module electronically linked to said trigger sensor to receive said trigger sensor signal and to said magazine sensor to receive said magazine sensor signal;

wherein said wireless module transmits said trigger sensor signal and said magazine sensor signal to said central simulation computer and receives commands from said central simulation computer using a radio-frequency transmission.

16. The weapon simulator assembly as described in claim 15 wherein said wireless module is uses a frequency hopping spread spectrum technology.

17. The weapon simulator assembly as described in claim 15 wherein the radio frequency of said radio-based transmission is substantially within the 2.4 GHz band.

18. A method for monitoring the status of a man-portable weapon simulator having a discrete weapon housing using a central processing unit, said method comprising the steps of:

a) continuously monitoring a variety of sensors mounted in the housing of the man-portable weapon simulator with a detection unit mounted within the housing;

b) generating sensor signals from said variety of sensors to said detection unit within the man-portable weapon simulator corresponding to the state of said respective sensors said simulated man portable weapon; and c) wirelessly transmitting said sensor signals from a wireless module in said detection unit having a wireless transceiver affixed within the man-portable weapon simulator to the central processing unit using a radio-frequency based transmission.

19. The method as described in claim 18, wherein step c) further comprises providing a frequency hopping spread spectrum technology to transmit said sensor signal from said wireless module.

20. The method as described in claim 18, wherein after step d) further comprising the steps of:

validating said sensor signal with the central processing unit to confirm the state of said simulated man-portable weapon; and triggering the firing of a laser module affixed to said simulated man-portable weapon.

21. The method as described in claim 18, further comprising the step of transmitting commands from the central processing unit to said detection unit to be executed by said simulated man-portable weapon.

22. A weapon simulator assembly imparting unbound motion for a user of said weapon simulator assembly, the weapon simulator assembly having a wireless connection to a first wireless transceiver of a central processing unit, wherein said weapon simulator assembly comprises:

an untethered simulated handles weapon having a frame;

a wireless module mounted within said frame of said simulated handles weapon, said wireless module having a second wireless module transceiver; and a trigger sensor mounted within said frame of said simulated handles weapon in uninterrupted electrical communication with said wireless module:

a magazine sensor mounted within said frame of said simulated handles weapon in uninterrupted electrical communication with said wireless module;

wherein said second wireless transceiver of said wireless module transmits said trigger sensor signal and said magazine sensor signal to the first wireless transceiver using a radio frequency based transmission.

23. The weapon simulator assembly as described in claim 22 further comprising a microcontroller connected to said simulated handles weapon.

* * * * *